United States Patent [19]

Morgan et al.

[11] 3,967,734

[45] July 6, 1976

[54] HAND DELIVERY TRUCK

[75] Inventors: Melvin G. Morgan, Broken Arrow; Cal L. Dixon, Tulsa, both of Okla.

[73] Assignee: Kaiser Aluminum & Chemical Corporation, Oakland, Calif.

[22] Filed: July 23, 1974

[21] Appl. No.: 491,090

[52] U.S. Cl. ..... 211/199; 211/126; 16/191; 280/638

[51] Int. Cl.[2] ..... A47F 5/10

[58] Field of Search ..... 160/135, 229; 280/36 R, 280/36 C, 79.3; 16/191; 211/177, 178, 148, 149, 182, 126; 248/45

[56] References Cited

UNITED STATES PATENTS

| | | | |
|---|---|---|---|
| 2,216,408 | 10/1940 | Elmer | 248/145 |
| 2,388,297 | 11/1945 | Slaughter | 160/229 R |
| 2,846,078 | 8/1958 | Shelby | 248/150 X |
| 2,891,802 | 6/1959 | Moran | 280/36 C |
| 2,994,441 | 8/1961 | Browning, Jr. | 211/177 |
| 3,168,329 | 2/1965 | Goldschmidt | 211/178 R X |
| 3,389,854 | 6/1968 | Coopersmith | 16/191 |
| 3,425,171 | 2/1969 | Propst et al. | 160/135 |
| 3,696,855 | 10/1972 | Kira | 160/135 |
| 3,722,701 | 3/1973 | Malcik et al. | 211/177 |
| 3,797,842 | 3/1974 | Swick, Jr. et al. | 280/36 R |

FOREIGN PATENTS OR APPLICATIONS

| | | | |
|---|---|---|---|
| 559,647 | 9/1923 | France | 160/229 R |

*Primary Examiner*—James T. McCall
*Assistant Examiner*—Terrell P. Lewis
*Attorney, Agent, or Firm*—Paul E. Calrow; John S. Rhoades

[57] ABSTRACT

Improved foldable hand delivery cart made up of a main and a pair of side or wing panel sections interlockingly hinged together by means of hinge elements which extend for substantially the entire lengths of the panel sections and simultaneously form structural columnar support components for said panel sections.

2 Claims, 4 Drawing Figures

HAND DELIVERY TRUCK

BACKGROUND OF INVENTION

The instant invention relates to wheeled hand carts or trucks and more particularly to a collapsible wheeled hand delivery cart, which upon expansion provides a support for a plurality of individually removable shelf or tray elements. The cart can be advantageously used in delivering goods to warehouses, supermarkets and similar mercantile establishments.

Prior art foldable hand delivery carts as represented by U.S. Pat. Nos. 2,891,802; 2,461,482; and 3,191,959 and which upon being unfolded were adapted to provide supports for shelving or trays, have not always been completely satisfactory. These delivery carts customarily were used to move goods from a main delivery vehicle to the retail outlet and employed hinged panel sections which were attached to each other by means of conventional pin and hinge elements separate from and separately fastened to the panel sections making up the cart. These pin and hinge elements were frequently made from a material different from the remaining parts of the cart, such as steel hinges and pins that were attached to light metal frames. When a cart so constructed was placed during use in an atmosphere or environment involving moisture, galvanic or bimetallic corrosion could occur.

The instant invention is concerned with a foldable and wheeled hand delivery cart made up of a main panel and a pair of wing panels. The panels are all preferably made of a light metal such as aluminum or magnesium. The side frame elements of the main and wing panels can advantageously comprise interlocking extruded shapes of a light metal which, when interfitted together, provide full length hinges for the wing panels and at the same time give added columnar support and strength to the movable wing panels.

SUMMARY OF THE INVENTION

The wheeled collapsible delivery cart of the instant invention is comprised of a main or back panel and the two side or wing panels. The cross-braces of these panels are made up of angle elements which serve as supports for removable shelves or trays. The side frame elements of these panels are advantageously made from interlockable and extruded light metal shapes that extend for substantially the full lengths of the panels. When assembled and interlocked, these side frame elements operate as full length hinges of extremely rugged construction. In addition to serving as hinges, these extruded shapes provide added columnar support and strength to the movable side panels. They avoid the problems of loosened hinge fasteners and bimetallic corrosion which can occur when the hinge elements are made from steel and the remainder of the cart from a light metal, such as aluminum or magnesium.

DETAILED DESCRIPTION

Figure 1:
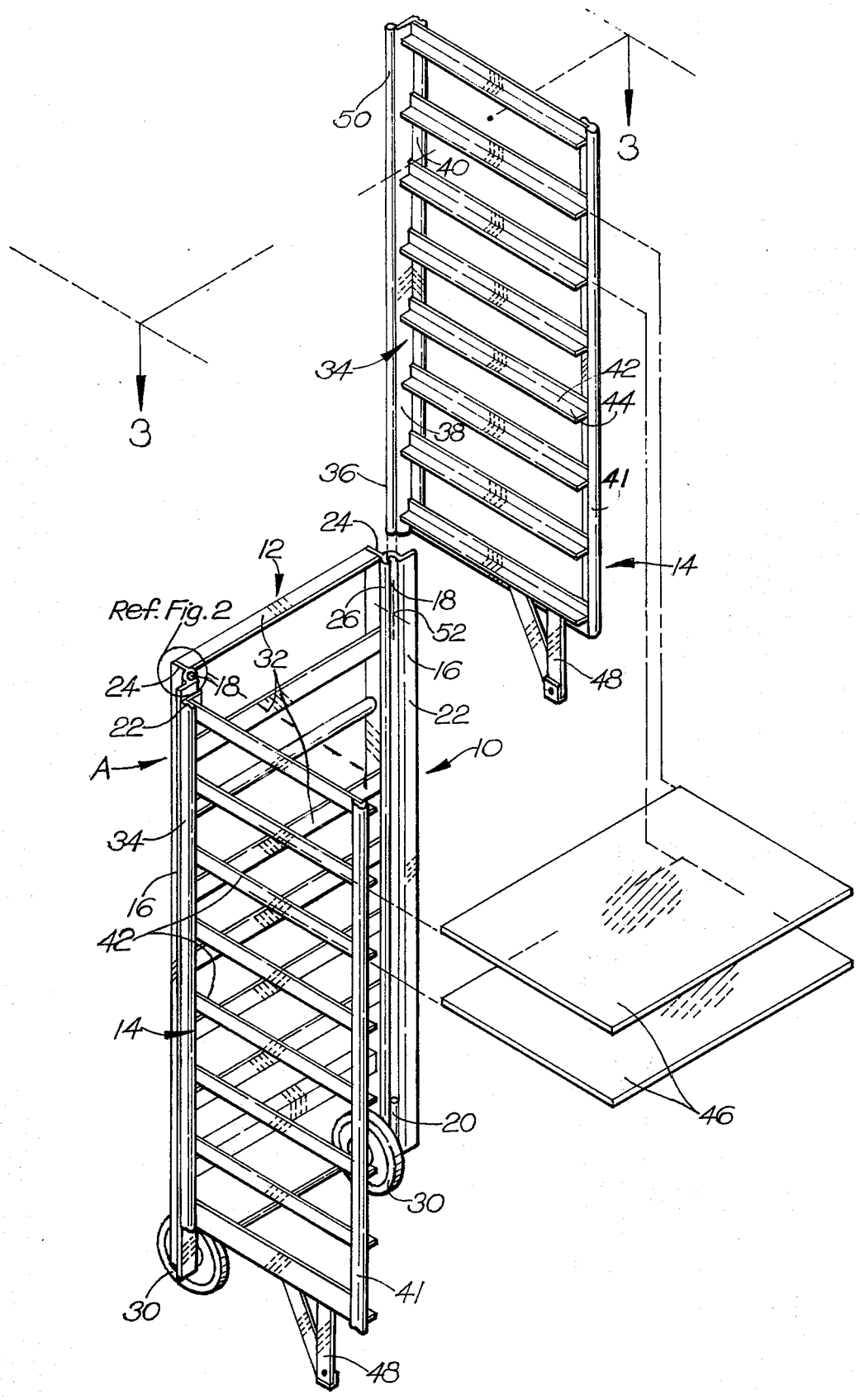
FIG. 1 is a perspective and partially exploded view of the wheeled foldable hand delivery cart of the instant invention and with the wing panels being shown in an extended or open position.

The foldable hand delivery cart 10 of the instant invention is generally comprised of a main or back panel 12 and a pair of side or wing panels 14. The side marginal edges of back panel 12 are made up of a pair of elongated extruded light metal angles 16 each of which includes a centrally disposed and inwardly opening arcuate groove 18 which extends for substantially the full length of the panel 12. The lower part of the groove 18 can be filled with a weldment or a pin element 20 welded in place which serves as a stop and anchor element for the side panels in a manner to be hereinafter described.

Angles 16 are made up of the flat front flanges 22 and flat rear flanges 24. Projecting from and integral with flange 24 adjacent the groove 18 is an enlargement 26 which serves as a stop element that controls the degree of pivot of a wing panel upon the collapse thereof in a manner to be hereinafter described. Enlargement 26 avoids the need for separate fittings, such as are indicated in U.S. Pat. Nos. 485,460; 2,990,572; and 3,178,762. A pair of wheels 30 are affixed to the bottom extremities of the extruded elements 16 in a manner well known in the art. The cross-bracing elements 32 also made from a light metal are welded to the inside surfaces of flanges 24 of extrusions 16 in the usual fashion to complete the structure of back panel 12.

Figure 3:
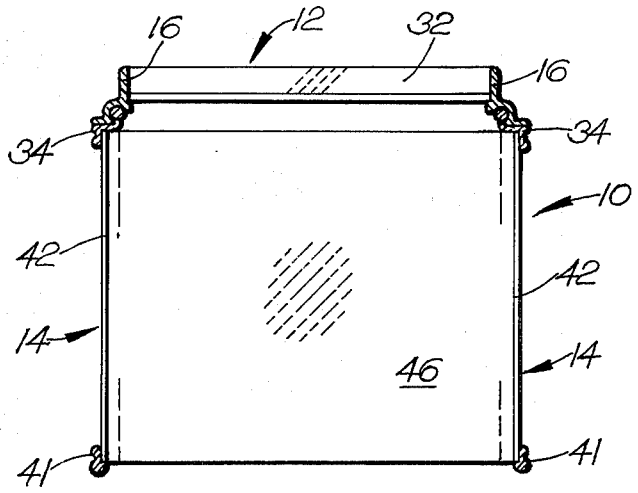
FIG. 3 is a top plan view of the cart of FIG. 1 with side panels attached and when opened to their fully extended position to support the cart shelving, and with parts shown in section.

Each wing panel is made up of a pair of light metal side frame extrusions. The inner and somewhat Z-shaped extrusion 34 that is hingedly interlocked with an extrusion 16 includes a bulbous portion 36, a main flange 38 connected to bulbous portion 36 by flange 39 and another partially arcuate flange extension 40. The other side edge of a wing panel 14 is made up of a simple light metal extrusion 41. Welded to the various side elements 34 and 41 are a series of generally parallel light metal cross-braces or angle components 42. The horizontal flanges 44 of the selectively spaced cross-angles 42 serve as supports for the individual trays or shelving 46 which are adapted to be removably disposed thereon after the wings 14 have been fully expanded in the manner shown in FIG. 3. Attached to the bottommost angle 42 of each side panel 14 is a bracket assembly 48 which serves as a ground engaging support for its respective side panel so that the weight of the side panel, etc. is not carried solely by the interlocking elements 16 and 34 of the hinge assemblies.

It will be noted with particular reference to FIG. 1 that the bulbous portion 36 of the angular side panel frame section 34 is adapted to be removably and telescopingly inserted within the elongated groove 18 until the bottom of the angle 34 contacts the stop 20 disposed in the lower reaches of groove 18. The groove opens inwardly and the bulbous portion 36 acts as a hinge pin in the interlocked pin and hinge assembly A formed thereby and is adapted to be pivoted a selected amount within the groove 18. The location of the stop element 20 determines the bottommost position of a side panel and since the hinge assembly A formed by frame components 16 and 34 extends for the full length of contact of these elements, the side panels 14 can be of lesser or somewhat greater length than the back panel 12 as indicated by the dotted lines in FIG. 1.

In order to prevent undesirable lengthwise sliding of the side sections 14 within the groove 18 of side component elements 16, each bulbous element 36 can be hollowed out or cut away adjacent the top thereof to form an elongated keyway 50. Keyway 50 is of appropriate size and length. Its longest dimension will usually be disposed at a transverse angle to the main axis of pivot of frame section 34 and it is adapted to register with opening or bore 52 in the wall of the extruded element 16 when the extrusion 34 is telescoped and retracted to its final position of rest in the slot or groove 18.

Figure 2:
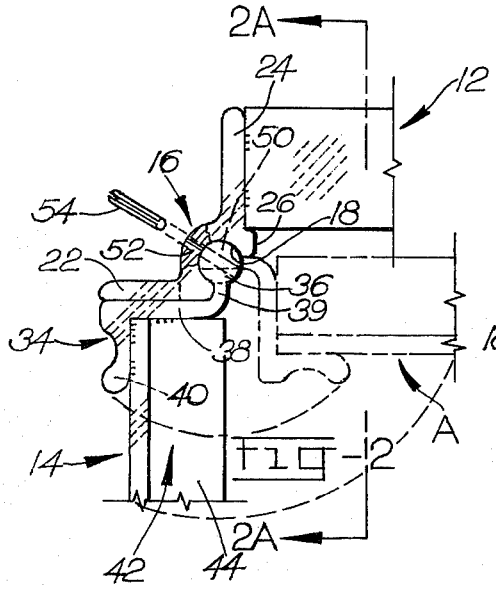
FIG. 2 is an enlarged top plan view of the extruded hinge elements used as the main and side panel frame elements with the hinge elements being pivoted to an open position and when taken generally within the circumscribing line 2—2 of FIG. 1.
Figure 2A:
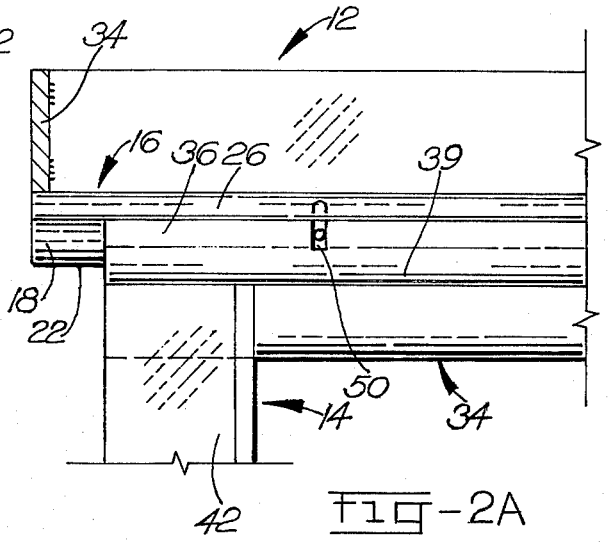
FIG. 2A is a fragmentary sectional view taken along line 2A—2A of FIG. 2 with parts removed and when rotated approximately 90° counter-clockwise.

When full registry of keyway 50 and bore 52 occurs, a removable locking pin element 54 can be thrust through the opening 52 until its point extends into the keyway 50. Keyway 50 is sufficiently large to provide full clearance between pin 54 and the edges of keyway 50 during pivoting of a side frame element 16 relative to a main panel element 12. If desired, the outermost part of a pin 54 can be exteriorly threaded whereby it can engage corresponding threads in the bore 52 in the wall of the extruded element 16 or it can be a simple pin of the type shown in FIG. 2 that does not have this threaded feature and depends on a friction fit for anchorage in bore 52.

In the use of the cart of the invention, enlargement 26 of flange 24 acts as a stop when a side panel is pivoted to a closed position inwardly while flange 22 of frame component 34 acts as a stop during opening of a wing panel 14 outwardly so as to prevent outward overpivoting of a side panel 14.

From the above, it will be observed that an improved and versatile foldable hand delivery cart has been provided of relatively simple yet rugged construction. The improved delivery cart construction eliminates the need for separate hinges and fasteners for securing the hinges to the various panel elements making up the cart. The interlockable columnar hinge elements also function as rugged integral frame sections for the panels whereby they act as structural components in addition to full length hinges. The aforesaid interlockable hinge elements permit within limits easy and ready replacement of different sized side panel parts, if the same are desired, and in the end provide a relatively versatile and compact delivery cart.

An advantageous embodiment has been shown and described and it is obvious that various changes may be made therein.

What is claimed is:

1. A foldable delivery cart of the type described comprising the combination of a main panel and a pair of wing panels, each of the wing panels being hingedly connected to the main panel for at least the major portion of the length of a wing panel and each of the marginal side edges of the main panel comprising an angular light metal extruded section provided with a centrally disposed arcuate groove which extends substantially continuously for the full length of the said angular section and said groove being bounded on one side thereof by a stop element formed integrally with the said angular section, the side edge of a wing panel that is connected to the main panel comprising a light metal Z-shaped extruded section provided with a main flange and adjacent oppositely projecting flange elements for accommodating and receiving shelving supports secured to said Z-shaped section, the inner terminal free end of the said Z-shaped extruded section comprising a bulbous portion that extends substantially the full length of the said Z-shaped extruded section and serves as a hinge pin that is telescopingly fitted and pivotally mounted within the groove of one of the said main panel angular sections, the degree of pivoting of a wing panel provided with the said Z-shaped extruded section in one direction being limited by the stop element on the main panel angular section that is cooperatively associated therewith, means including a further stop element disposed in the bottom part of the groove of the said cooperatively associated main panel angular section and engageable with the bottom part of the bulbous portion of the said wing panel Z-shaped extruded section for anchoring the said bulbous portion of the said wing panel Z-shaped extruded section in the groove of the said cooperatively associated main panel angular section and the wing panel provided with said Z-shaped extruded section to the main panel.

2. A foldable delivery cart as set forth in claim 1 wherein the bulbous portion of the said wing panel Z-shaped extruded section is provided with a cut out section which forms a keyway and pin means insertable through an opening in the angular section of the main panel associated with the said wing panel Z-shaped extruded section and in the keyway of the said bulbous portion for locking the said wing panel to the main panel.

* * * * *